United States Patent [19]
Kehrer et al.
[11] 4,294,312
[45] Oct. 13, 1981

[54] TUBE-BUNDLE HEAT EXCHANGER FOR COOLING A MEDIUM HAVING A HIGH INLET TEMPERATURE

[75] Inventors: Wolfgang Kehrer; Helmut Lachmann, both of Berlin, Fed. Rep. of Germany

[73] Assignee: Borsig GmbH, Berlin, Fed. Rep. of Germany

[21] Appl. No.: 141,327

[22] Filed: Apr. 18, 1980

[30] Foreign Application Priority Data

Nov. 9, 1979 [DE] Fed. Rep. of Germany ..... 2945844

[51] Int. Cl.[3] ..... F28F 9/22
[52] U.S. Cl. ..... 165/134 R; 165/142; 165/145; 165/158
[58] Field of Search ..... 165/142, 145, 134, 158, 165/143, 134 R, 134 DP

[56] References Cited

U.S. PATENT DOCUMENTS

| | | | |
|---|---|---|---|
| 872,129 | 11/1907 | Heffley | 165/158 |
| 2,801,831 | 8/1957 | Clarkson | 165/142 |
| 3,681,936 | 8/1972 | Park | 165/158 |

FOREIGN PATENT DOCUMENTS

| | | | |
|---|---|---|---|
| 614877 | 5/1935 | Fed. Rep. of Germany | 165/158 |
| 260066 | 10/1926 | United Kingdom | 165/158 |

*Primary Examiner*—Sheldon J. Richter
*Attorney, Agent, or Firm*—Becker & Becker, Inc.

[57] ABSTRACT

A tube-bundle heat exchanger for cooling a medium having a high inlet temperature. The heat exchanger has an inlet tube bottom and an outlet tube bottom, in which are fastened the ends of tubes which connect the bottoms and through which the medium of high inlet temperature flows. An intermediate tube bottom, having insert tubes arranged concentrically in the tubes, is located in the inlet chamber, with these insert tubes projecting out on both sides from the tubes and forming annular spaces therewith. Toward the inlet chamber, the annular spaces open into an intermediate chamber limited by the inlet tube bottom and the intermediate tube bottom; in the opposite direction, the annular spaces open into a deflecting or reversing chamber sealingly covering the insert tubes.

4 Claims, 5 Drawing Figures

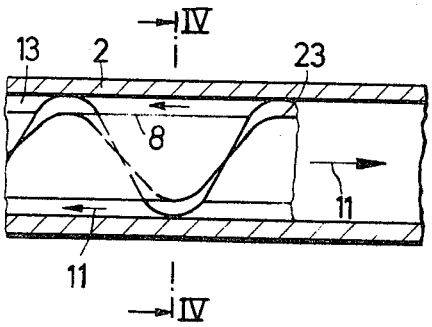
Fig.3
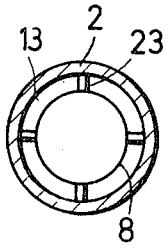
Fig.4
Fig.5
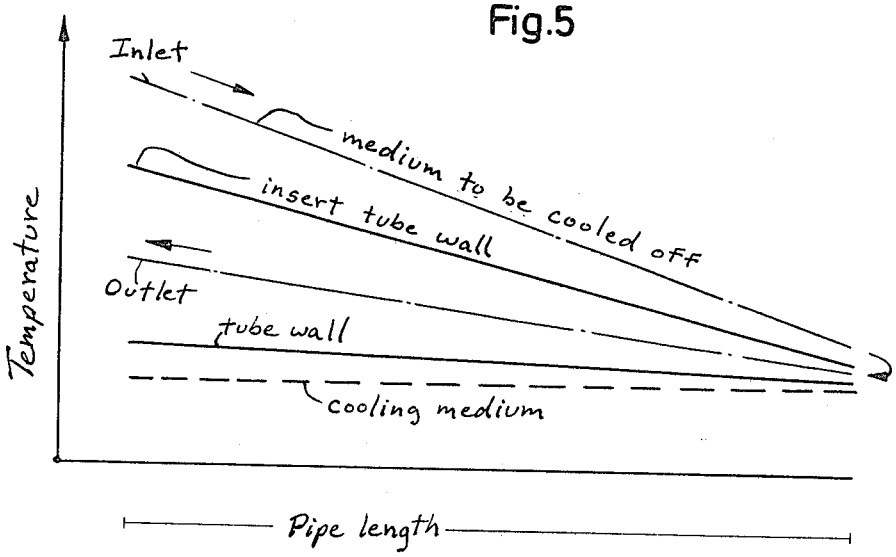

TUBE-BUNDLE HEAT EXCHANGER FOR COOLING A MEDIUM HAVING A HIGH INLET TEMPERATURE

The present invention concerns a tube-bundle heat exchanger for cooling a medium having a high inlet temperature, and has an inlet tube bottom and an outlet tube bottom, in which are fastened the ends of tubes which connect the bottoms and through which the medium of high inlet temperature flows.

Components or measures are necessary with such tube-bundle heat exchangers upon the inlet side of the hot medium to protect the regions of high heat loading.

It is known, for fulfilling these requirements, to use inlet funnels or nozzles which reduce the heat loading in the connection region of the tube or inlet tube bottom. When a very hot medium is involved, which is to be cooled off, the effect of the funnels or nozzles often is not adequate to sufficiently reduce the heat loading in the inlet region.

The basic object of the invention is to create a tube-bundle heat exchanger with which high local heat loading can be avoided with certainty, and a more uniform heat loading can be attained along the tube.

This object, and other objects and advantages of the present invention, will appear more clearly from the following specification in connection with the accompanying drawings, in which:

FIG. 3 is an enlarged sectional illustration as a detail of the circularly enclosed region X in FIG. 2.

FIG. 4 is a section taken along the line IV—IV in FIG. 3.

FIG. 5 is a graphical illustration with the temperature curve as a function of the tube length for the medium to be cooled off from the inlet to the outlet, as well as for the wall temperature of an insert tube, the wall temperature of a tube, and the cooling medium of the tube-bundle heat exchanger according to FIG. 1.

Figure 1:
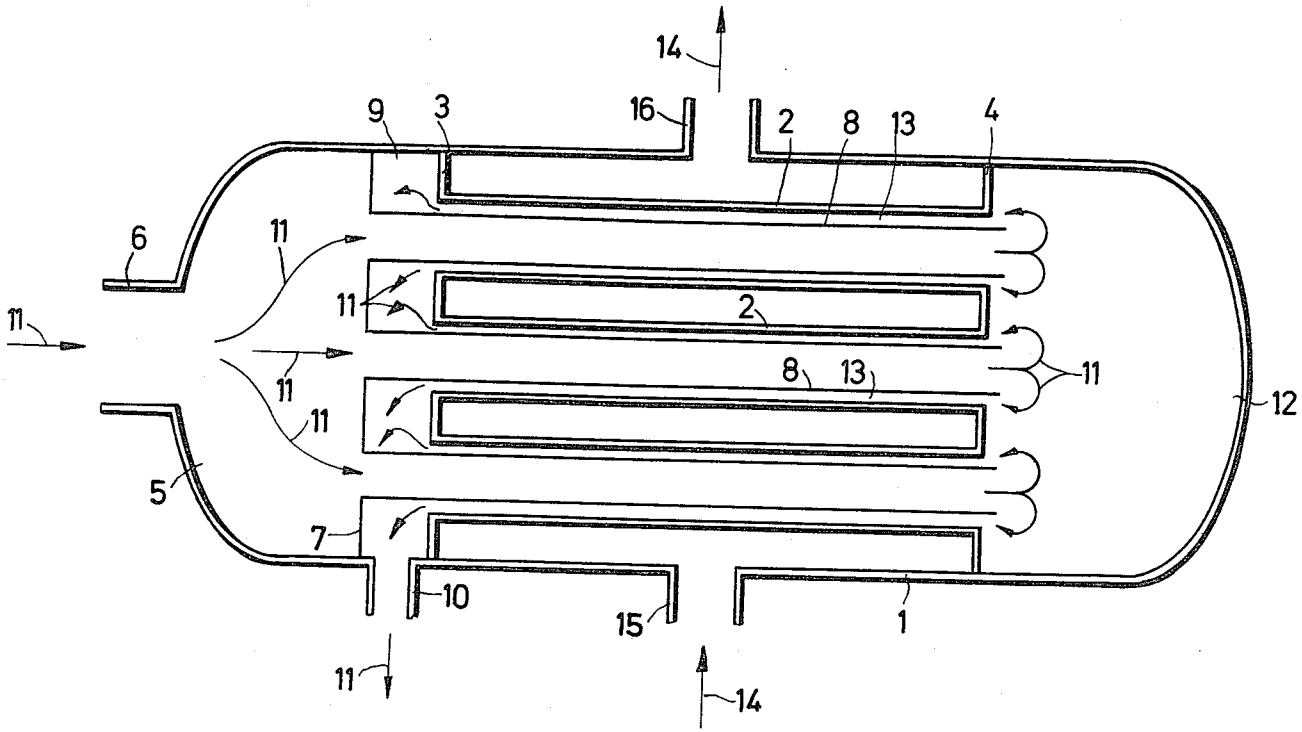
FIG. 1 is a longitudinal section through a tube-bundle heat exchanger with insert tubes in all tubes.

The tube-bundle heat exchanger of the present invention is characterized primarily in that an intermediate tube bottom, having insert tubes arranged concentrically in the tubes, is located in the inlet chamber, with the insert tubes projecting out on both sides from the tubes and forming annular spaces therewith; the annular spaces open, toward the inlet chamber, into an intermediate chamber defined or limited by the inlet tube bottom and the intermediate tube bottom, and open in the opposite direction into a diverting or reversing chamber sealingly covering the insert tubes.

Inventively, all tubes may contain insert tubes, with the reversing chamber being connected with the cylindrical shell or wall of the tube-bundle heat exchanger, and with the intermediate chamber being provided with a discharge or outlet for cooled-off medium.

To achieve that the cooled-off medium located in the intermediate chamber is cooled off still further, according to a further embodiment of the invention, preferably only those tubes located in a concentric circle with respect to the cross section of the shell of the tube-bundle heat exchanger have insert tubes, with the reversing chamber being connected concentrically to an outlet chamber which adjoins the shell and surrounds the reversing chamber; those tubes located in an annular chamber having a circular cross section and located externally of the reversing chamber, have a direct connection, through the tubes without insert tubes, between the intermediate chamber and the outlet chamber, which has an outlet for the cooled-off medium.

To assure that the medium cooled off in the insert tubes and the annular spaces, as well as in the tubes, also always leaves the heat exchanger with the desired temperature even with different contamination conditions as well as partial load operation, according to a further embodiment of the invention, the reversing chamber has an outlet within the outlet or discharge chamber, with an adjustable throttling flap being located in the outlet.

To assure that a high speed of the medium being cooled-off exists in the annular spaces between the insert tube and the tube, according to the present invention, spiral-like strips are arranged in the annular spaces.

To assure that the cooled-off medium located in the intermediate chamber of the inlet chamber does not warm up again by heat transported through the intermediate bottom, inventively, that wall of the intermediate tube bottom facing the inlet chamber, and the adjoining inner walls of the inlet ends of the insert tubes, are covered with an insulating layer of temperature-resistant material.

The advantages attained with the present invention consist especially therein that the entering medium to be cooled off does not come into direct contact with the wall of the tubes cooled by the cooling medium, but rather that the heat thereof is first given off through the wall of the insert tube to the medium to be cooled off flowing in the annular space, and from this is given off to the cooled wall, whereby by means of the described inventive embodiments, there is achieved that the temperature of the medium to be cooled off flowing in the annular space, at every location of the flow path, is lower than the temperature of the medium to be cooled off flowing in the insert tubes, and that the temperature is higher than that of the cooling medium.

A typical field of application is the recovery of waste heat from a very hot gas for the steam generation. In this connection, it is advantageous that the wall temperature of the tubes, which are frequently pressure-carrying tubes, remains low. A further typical field of application is the protective heating of the cooling medium by a high temperature medium which is to be cooled off, whereby the cooling medium does not experience any local overheating at the tube from the relatively low wall temperature of the tubes (foodstuff technology).

Referring now to the drawings in detail, the tube-bundle heat exchanger comprises the shell or wall 1, the tubes 2, which are fastened in the inlet tube base or bottom 3 and the outlet tube base or bottom 4, the inlet chamber 5 with the inlet 6, and, in the inlet chamber 5, the intermediate tube bottom 7 with the insert tubes 8 attached thereto, and accommodated in the tubes 2 and projecting with both ends therefrom. The inlet tube bottom 3, with the intermediate tube bottom 7, forms the intermediate chamber 9 to which, according to the embodiment of FIG. 1, the discharge 10 for cooled-off medium is connected, whereby here the path of the medium to be cooled off is represented by the arrows 11. Apparent therefrom is that, according to FIG. 1, the medium to be cooled off passes through the inlet 6, the inlet chamber 5, and the insert tubes 8 into the deflecting or reversing chamber 12, which sealingly covers all tubes 2 and is here connected with the wall 1. The medium flows from the reversing chamber 12, through the annular spaces 13, and further through the intermediate chamber 9 and the discharge or outlet 10. The cooling medium around the tubes 2 flows in the direction of the arrows 14 through the inlet 15 into the tube-bundle heat exchanger and departs therefrom through the outlet or discharge 16.

Figure 2:
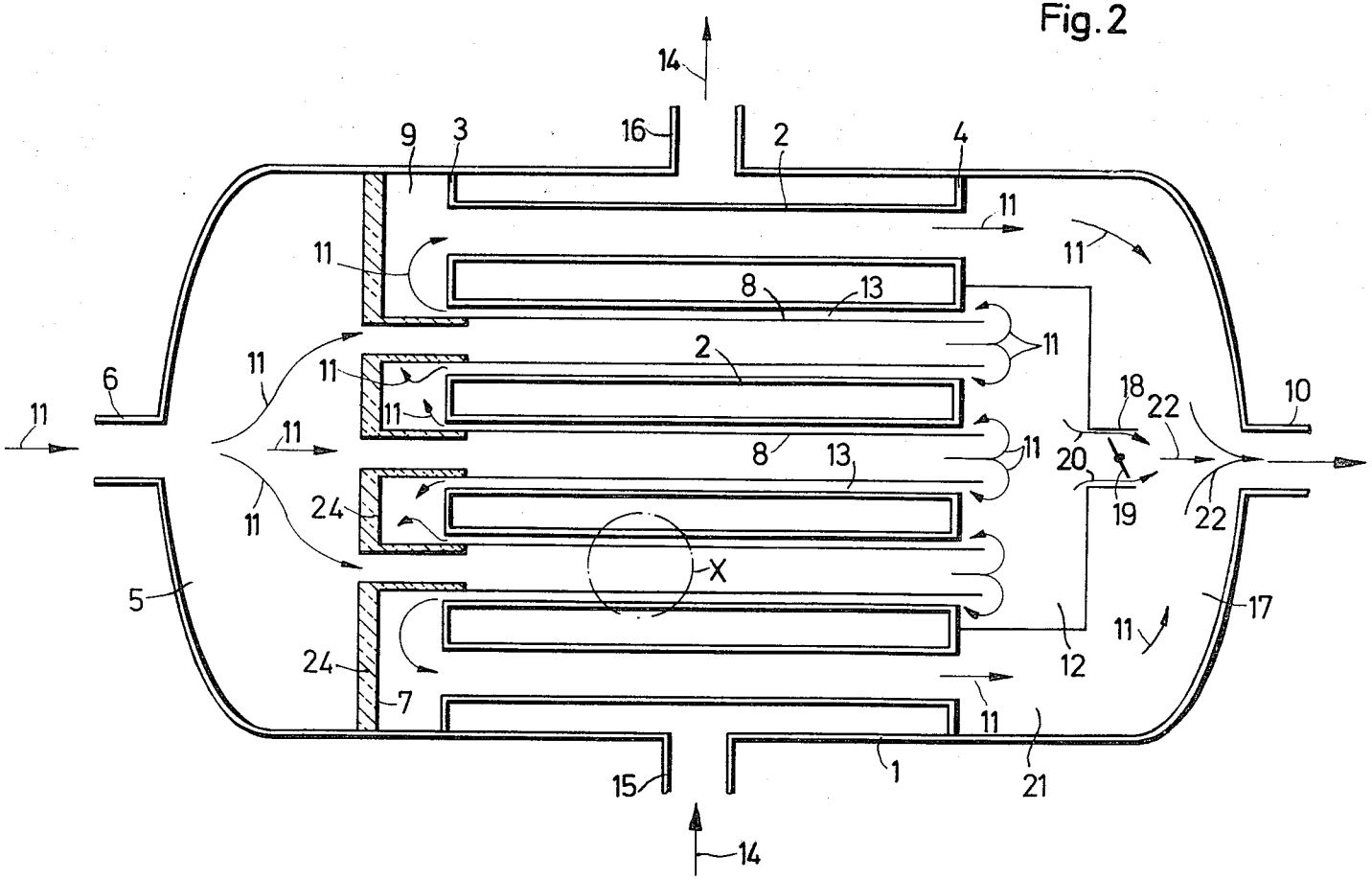
FIG. 2 is a longitudinal section through a tube-bundle heat exchanger, with insertables only within a circular surface concentric to the shell or wall of the tube-bundle heat exchanger,, and with a direct connection, changeable in cross section, between the reversing or diverting chamber and the discharge chamber.

With the embodiment according to FIG. 2, only those tubes 2 located within a concentric circle with respect to the cross section of the wall 1 are provided with insert tubes 8, in which connection this circle is sealingly covered by the reversing chamber 12. From the intermediate chamber 9, which here has no outlet, the medium to be cooled passes through the tubes 2 without insert tubes 8 accompanied by further cooling in the discharge or outlet chamber 17, which surrounds the reversing chamber 12 and is connected with the wall 1, and leaves the chamber 17 through the outlet 10.

In the event that a desired outlet or discharge temperature of the cooled-off medium is also required with different degrees of contamination, as well as in partial load operation, the outlet or discharge 18, for example coaxial to the outlet 10 in FIG. 2, is provided on the reversing chamber 12 with a throttling valve 19 located therein, whereby a partial flow of less cooled-off medium, through the outlet 18 in the direction of the arrows 20, meets with the other partial flow of more strongly cooled-off medium through the annular chamber 21 in the direction of the arrows 11, with the partial flows leaving the tube-bundle heat exchanger as a mixture through the outlet 10 in the direction of the arrows 22.

The spiral-shaped strips for generation of higher speeds in the annular spaces 13 are designated with the reference numeral 23, and the insulating layer at the intermediate tube bottom 7 and the inner walls of the inlet ends of the insert tubes 8 are designated with the reference numeral 24.

FIG. 5 is a graph corresponding to the tube-bundle heat exchanger according to FIG. 1, in which the temperatures of the medium to be cooled off and of the cooling medium, as well as the material temperatures of the insert tubes 8 and of the tubes 2 are illustrated. For simplification of the illustration, the cooling medium is represented with a constant temperature (boiling cooling).

The present invention is, of course, in no way restricted to the specific disclosure of the specification and drawings, but also encompasses any modifications within the scope of the appended claims.

What we claim is:

1. A tube-bundle heat exchanger, for cooling a medium having a high inlet temperature, which comprises:

a shell having an inlet, inlet chamber, and outlet for said medium to be cooled, an inlet and outlet for cooling medium, and a reversing chamber, for medium to be cooled, at that end of said shell remote from said inlet chamber;

an inlet tube bottom and an outlet tube bottom supported at least in part by said shell;

a plurality of tubes, the ends of which are respectively fastened to and connect said inlet and outlet tube bottoms, said medium to be cooled flowing through said tubes;

an intermediate tube bottom supported at least in part by said shell and located in said inlet chamber in such a way as to form an intermediate chamber between said inlet tube bottom and said intermediate tube bottom; and insert tubes respectively connected to said intermediate tube bottom and located concentrically in at least some of said tubes and projecting out on both sides from respective tubes, those ends of said insert tubes remote from said inlet chamber being sealingly covered by said reversing chamber, said insert tubes being spaced from respective tubes to form annular spaces therebetween, said annular spaces, toward said inlet chamber, opening into said intermediate chamber, and, in the opposite direction, opening into said reversing chamber;

only those tubes located in a concentric circle with respect to the cross section of said shell including insert tubes, and said shell including an outlet chamber, for cooled-off medium, which concentrically surrounds said reversing chamber in such a way that an annular chamber of circular cross section is formed around said reversing chamber between it and said shell, those tubes present in said annular chamber externally of said reversing chamber not including insert tubes and having a direct connection between said intermediate chamber and said outlet chamber with said outlet for cooled-off medium.

2. A heat exchanger according to claim 1, in which said reversing chamber has an outlet for communication of said reversing chamber with said outlet chamber, said last mentioned outlet being provided with an adjustable throttle valve.

3. A heat exchanger according to claim 1, in which spiral strips are arranged in said annular chamber.

4. A heat exchanger according to claim 1, which includes an insulating layer of temperature-resistant material on that wall of said intermediate tube bottom facing said inlet chamber, and on the adjacent inner wall of the inlet ends of said insert tubes.

* * * * *